US010734181B1

(12) United States Patent
Liu et al.

(10) Patent No.: US 10,734,181 B1
(45) Date of Patent: Aug. 4, 2020

(54) CARBON NANOTUBE FIELD EMITTER AND PREPARATION METHOD THEREOF

(71) Applicants: Tsinghua University, Beijing (CN); HON HAI PRECISION INDUSTRY CO., LTD., New Taipei (TW)

(72) Inventors: Peng Liu, Beijing (CN); Duan-Liang Zhou, Beijing (CN); Chun-Hai Zhang, Beijing (CN); Li Qian, Beijing (CN); Yu-Quan Wang, Beijing (CN); Xue-Wei Guo, Beijing (CN); Li-Yong Ma, Beijing (CN); Fu-Jun Wang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/661,152

(22) Filed: Oct. 23, 2019

(30) Foreign Application Priority Data

Jul. 16, 2019 (CN) ..... 2019 1 0642092

(51) Int. Cl.
*H01J 1/304* (2006.01)
*H01J 9/02* (2006.01)

(52) U.S. Cl.
CPC ..... *H01J 1/304* (2013.01); *H01J 9/025* (2013.01); *H01J 2201/30469* (2013.01)

(58) Field of Classification Search
CPC ... H01J 1/304; H01J 9/025; H01J 2201/30469
See application file for complete search history.

(56) References Cited

U.S. PATENT DOCUMENTS 6,890,780 B2 * 5/2005 Lee ..... B82Y 10/00 257/79

* cited by examiner

*Primary Examiner* — Joseph L Williams
*Assistant Examiner* — Jose M Diaz
(74) *Attorney, Agent, or Firm* — ScienBiziP, P.C.

(57) ABSTRACT

A method for making a carbon nanotube field emitter is provided. At least one carbon nanotube wire and at least two electrodes are provided. The at least one carbon nanotube wire is heated to form at least one graphitized carbon nanotube wire. The at least one graphitized carbon nanotube wire comprises a first end and a second end, and the first end is opposite to the second end. The at least two electrodes are welded to fix the first end between the at least two electrodes. welding the at least two electrodes to fix the first end between the at least two electrodes. The second end of the at least one graphitized carbon nanotube wire is exposed from the at least two electrodes as an electron emission end.

12 Claims, 7 Drawing Sheets

CARBON NANOTUBE FIELD EMITTER AND PREPARATION METHOD THEREOF

CROSS-REFERENCE TO RELATED APPLICATIONS

This application claims all benefits accruing under 35 U.S.C. § 119 from China Patent Application No.201910642092.6 filed on Jul. 16, 2019, in the China National Intellectual Property Administration, the contents of which are hereby incorporated by reference. This application is related to commonly-assigned applications entitled, "CARBON NANOTUBE FIELD EMITTER AND PREPARATION METHOD THEREOF", filed Oct. 23, 2019; Ser. No. 16/661,141; "CARBON NANOTUBE FIELD EMITTER AND PREPARATION METHOD THEREOF", filed Oct. 23, 2019 Ser. No. 16/661,148.

FIELD

The present disclosure relates to an evaporating source for a carbon nanotube field emitter and preparation method thereof.

BACKGROUND

In recent years, with the deepening of research on carbon nanotubes and nanomaterials, the broad applications of carbon nanotubes are constantly emerging. For example, due to the unique electromagnetic, optical, mechanical, and chemical properties of the carbon nanotubes, a large number of applications have been reported related to their applications in field emission electron sources, sensors, new optical materials, and soft ferromagnetic materials.

The field emission characteristics of the carbon nanotube have broad application prospects in fields such as field emission planar display devices, electric vacuum devices, and high-power microwave devices. Conventionally, a carbon nanotube wire is used as a field emitter, and the carbon nanotube wire is disposed on a surface of an electrode through a binder. The carbon nanotube wire can be easily pulled out during field emission, resulting in poor stability and short lifetime of the carbon nanotube field emitter. In addition, the carbon nanotubes in the carbon nanotube wire may have growth defects, resulting the carbon nanotube field emitter having poor stability and short lifetime.

BRIEF DESCRIPTION OF THE DRAWINGS

Implementations of the present technology will now be described, by way of embodiment, with reference to the attached figures.

DETAILED DESCRIPTION

Figure 1:
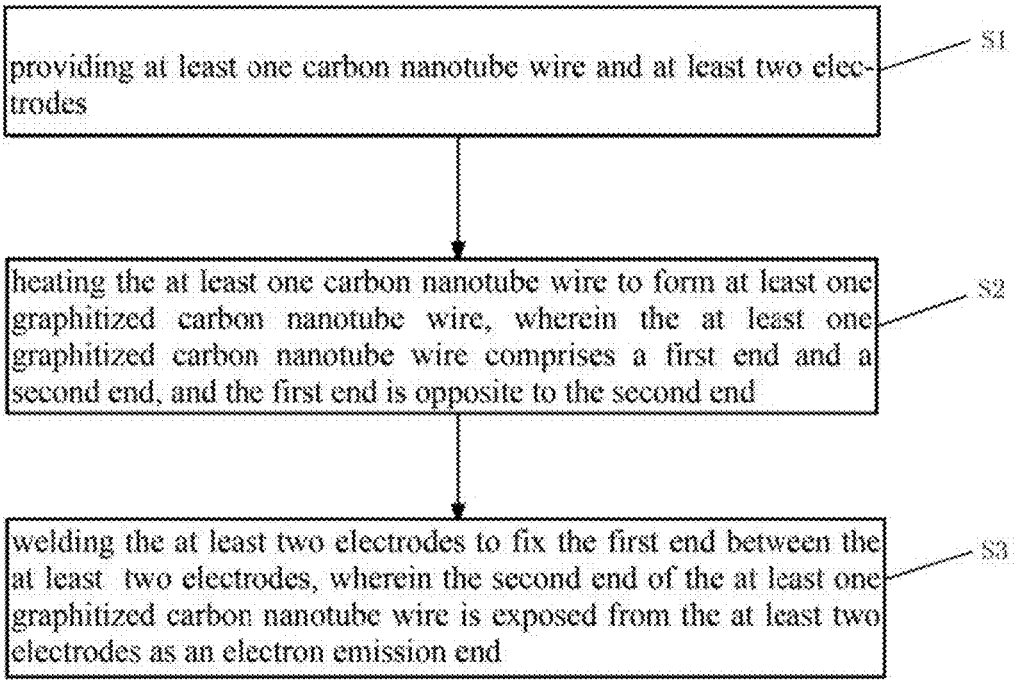
FIG. 1 is a flowchart of one embodiment of a method for making a carbon nanotube field emitter.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one".

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to illustrate details and features of the present disclosure better.

Several definitions that apply throughout this disclosure will now be presented.

The term "comprise" or "comprising" when utilized, means "include or including, but not necessarily limited to"; it specifically indicates open-ended inclusion or membership in the so-described combination, group, series, and the like.

In FIG. 1, one embodiment is described in relation to a method for making a carbon nanotube field emitter. The method comprises steps of:

step (S1), providing at least one carbon nanotube wire and at least two electrodes;

step (S2), heating the at least one carbon nanotube wire to form at least one graphitized carbon nanotube wire, wherein the at least one graphitized carbon nanotube wire comprises opposite a first end and a second end; and step (S3), welding the at least two electrodes to fix the first end between the at least two electrodes, wherein the second end of the at least one graphitized carbon nanotube wire is exposed from the at least two electrodes as an electron emission end.

Figure 2:
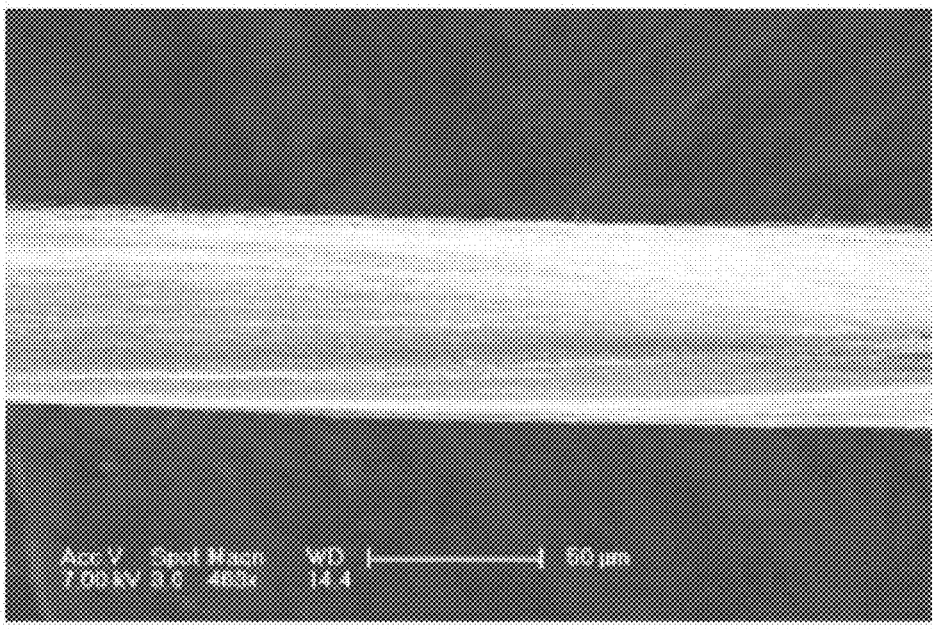
FIG. 2 is an SEM image of an untwisted carbon nanotube wire.

In step (S1), the carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into an untwisted carbon nanotube wire. Referring to FIG. 2, the untwisted carbon nanotube wire comprises a plurality of carbon nanotubes substantially oriented along a same direction (i.e., a direction along the length of the untwisted carbon nanotube wire). The carbon nanotubes are substantially parallel to the axis of the untwisted carbon nanotube wire. More specifically, the untwisted carbon nanotube wire comprises a plurality of successive carbon nanotube segments joined end to end by van der Waals attractive force therebetween. Each carbon nanotube segment comprises a plurality of carbon nanotubes substantially parallel to each other, and combined by van der Waals attractive force therebetween. The carbon nanotube segments can vary in width, thickness, uniformity, and shape. The length of the untwisted carbon nanotube wire can be arbitrarily set as desired. A diameter of the untwisted carbon nanotube wire ranges from about 0.5 nanometers to about 100 micrometers.

Figure 3:
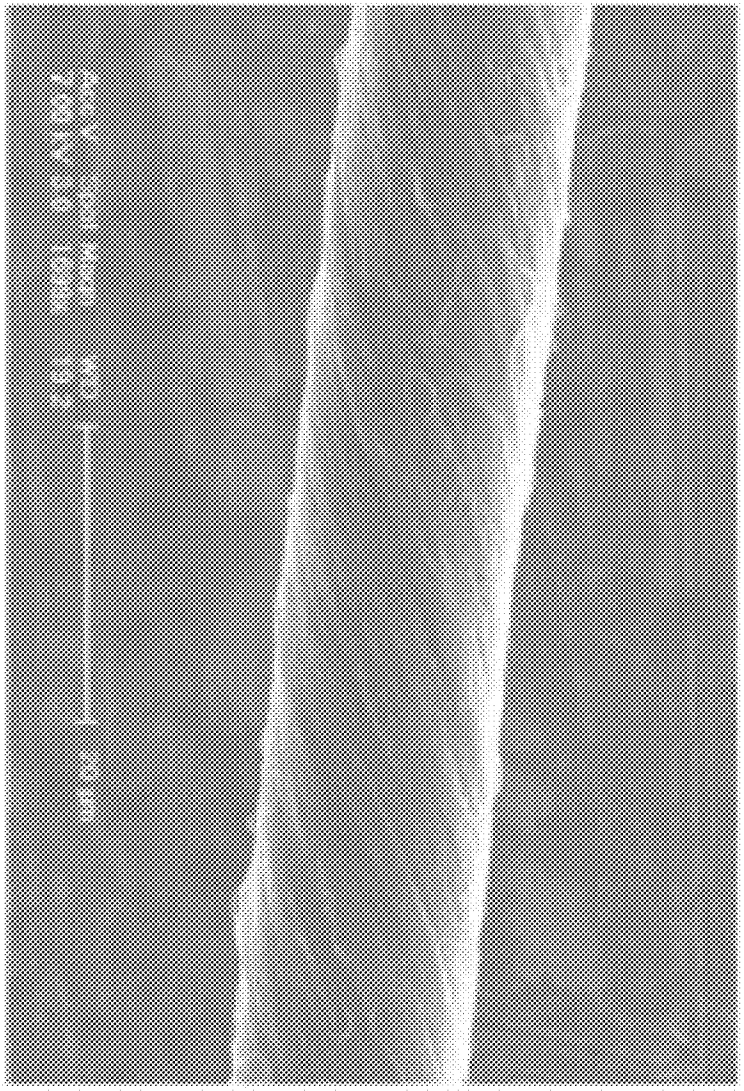
FIG. 3 is an SEM image of a twisted carbon nanotube wire.

The twisted carbon nanotube wire can be formed by twisting a drawn carbon nanotube film using a mechanical force to turn the two ends of the drawn carbon nanotube film in opposite directions. Referring to FIG. 3, the twisted carbon nanotube wire comprises a plurality of carbon nanotubes helically oriented around an axial direction of the twisted carbon nanotube wire. More specifically, the twisted carbon nanotube wire comprises a plurality of successive carbon nanotube segments joined end to end by van der Waals attractive force therebetween. Each carbon nanotube segment includes a plurality of carbon nanotubes parallel to each other, and combined by van der Waals attractive force therebetween. The length of the carbon nanotube wire can be set as desired. A diameter of the twisted carbon nanotube wire can be from about 0.5 nanometers to about 100 micrometers. Further, the twisted carbon nanotube wire can be treated with a volatile organic solvent after being twisted to bundle the adjacent paralleled carbon nanotubes together. The specific surface area of the twisted carbon nanotube wire will decrease, while the density and strength of the twisted carbon nanotube wire will increase.

The structure of the untwisted carbon nanotube wire and the preparation method thereof can be found in the application filed by Fan Shoushan et al. on Sep. 16, 2002, and the patent number is CN100411979C. The twisted carbon nanotube wire and the preparation method thereof can be found in the application filed by Fan Shoushan et al. on Dec. 16, 2005, and the patent number CN100500556C. For the sake of space saving, the structure of the untwisted carbon nanotube wire and the twisted carbon nanotube wire will not be described in detail here.

In step (S2), the carbon nanotube wire is heated to form the graphitized carbon nanotube wire by the following substeps: (S21) placing the carbon nanotube wire in a graphite crucible and then placing the graphite crucible in a graphitization furnace; (S22) heating the carbon nanotube wire to a temperature ranging from about 2000° C. to about 3000° C. for about 10 to 300 minutes in the graphite furnace with an inert gas; (S23) cooling to room temperature to form the graphitized carbon nanotube graphitization furnace. Then, the graphitized carbon nanotube graphitization furnace can be taken out of the graphite furnace. In one embodiment, the carbon nanotube wire is placed in the graphite crucible and then placed the graphite crucible in the graphitization furnace, then the carbon nanotube wire is heated to about 2800° C. for about 60 minutes under argon gas protection, and the temperature of the graphitization furnace is cooled to room temperature to form the graphitized carbon nanotube wire. The graphitized carbon nanotube wire is then taken out of the graphitization furnace.

The heat treatment of the carbon nanotube wire can remove high temperature volatile impurities (such as metal catalysts) in the carbon nanotube wire to form a graphitized carbon nanotube wire, and eliminate microscopic structural defects.

In step (S3), welding at least two electrodes to fix the first end of the at least one graphitized carbon nanotube wire between the adjacent two electrodes and to expose the second end as an electron emission end, thereby forming a carbon nanotube field emitter.

Figure 4:
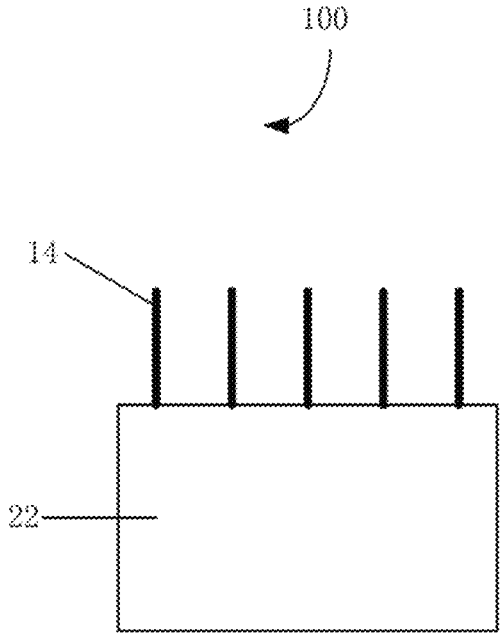
FIG. 4 is a main view of one embodiment of the carbon nanotube field emitter.
Figure 5:
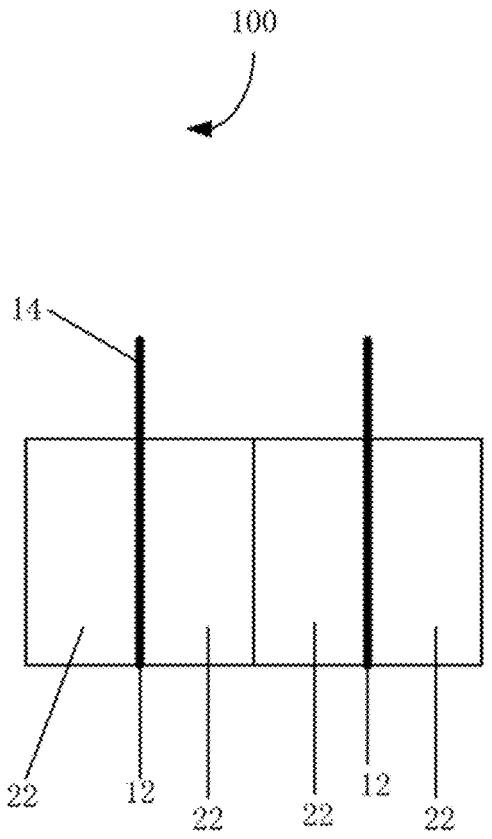
FIG. 5 is a side view of one embodiment of the carbon nanotube field emitter.
Figure 6:
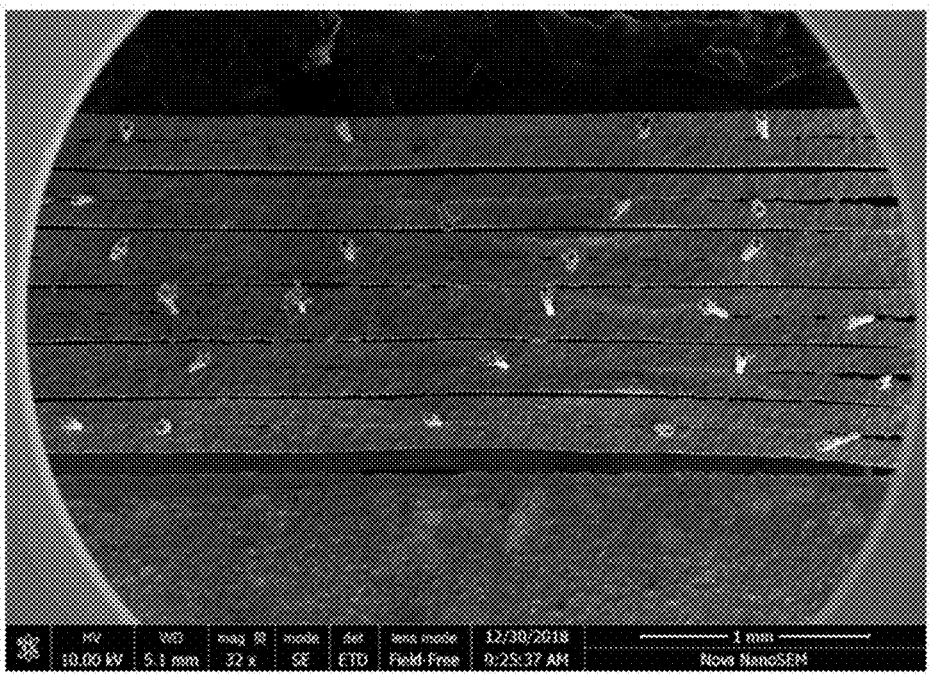
FIG. 6 is an SEM image of the carbon nanotube field emitter.
Figure 7:
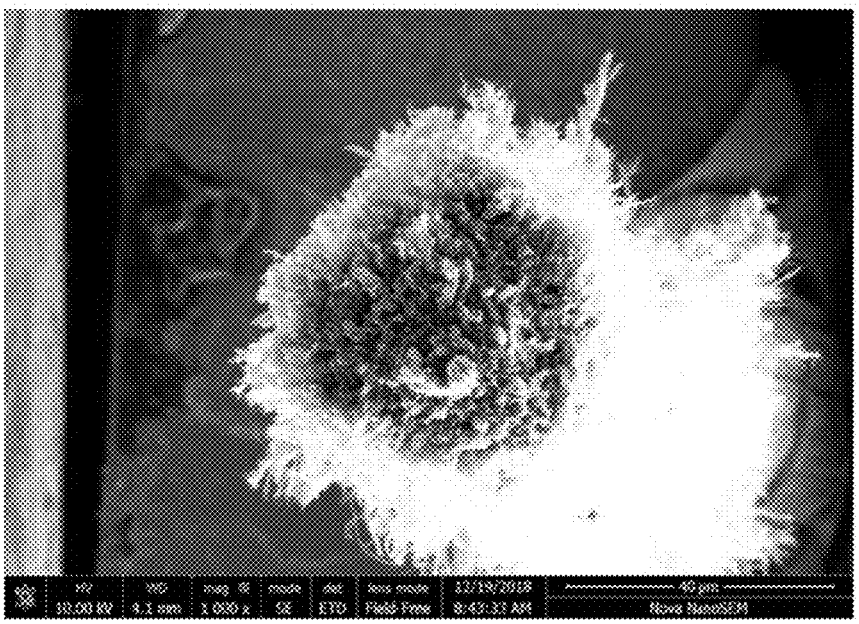
FIG. 7 is an SEM image of a second end of the carbon nanotube field emitter.

Referring to FIG. 4 and FIG. 5, each of the graphitized carbon nanotube wire comprises a first end 12 and a second end 14, and the first end 12 is opposite to the second end 14. The at least two electrodes 22 are fixed together by spot welding or laser welding, thereby fixing at least one first end 12 between adjacent two electrodes 22 while simultaneously exposing at least one portion of the second end 14 as an electron emitting end. The distance from the second end 14 to the top of the electrode 22, that is, the length of the bare second end 14 ranges from about 1 micrometer to about 5 millimeters. In one embodiment, the distance from the second end 14 to the top of the electrode 22 ranges from about 1 micrometer to about 3 millimeters. In another embodiment, the distance from the second end 14 to the top of the electrode 22 is about 250 micrometers.

The first end of the at least one graphitized carbon nanotube wire is fixed between the adjacent two electrodes 22 by spot welding comprises the following substeps: S311, placing the first end 12 of the at least one graphitized carbon nanotube wire between the adjacent two electrodes 22, wherein the adjacent two electrodes 22 clamps the at least one graphitized carbon nanotube wire, and the second end 14 is exposed to form an emission unit; S312, placing the emission unit between a fixed welding head and a movable spot welding head, and driving a pressure driving device to press the movable spot welding head against the fixed spot welding head; S313, controlling the spot welder output voltage and current to weld the adjacent two electrodes 22 together to fix the first end 12 of the at least one graphitized carbon nanotube wire.

In step S311, the emission unit may comprise only one graphitized carbon nanotube wire, and may also comprises a plurality of graphitized carbon nanotube wires. When the emitting unit comprises a plurality of graphitized carbon nanotube wires, the plurality of graphitized carbon nanotube wires are spaced apart from each other and sandwiched and fixed by the adjacent two electrodes 22. In one embodiment, the distance between adjacent two graphitized carbon nanotube wires is uniform. When the first end 12 of the graphitized carbon nanotube wire is placed between the two electrodes 22, the lengthwise direction of the graphitized carbon nanotube wire is set to be parallel to the electron emission of the carbon nanotube field emitter direction. In one embodiment, when the graphitized carbon nanotube wire is an untwisted carbon nanotube wire, the extending direction of the carbon nanotubes in the graphitized carbon nanotube wire is parallel to the electron emission direction of the carbon nanotube field emitter. When the graphitized carbon nanotube wire is a twisted carbon nanotube wire, the carbon nanotubes in the graphitized carbon nanotube wire are helically oriented around the electron emission direction of the carbon nanotube field emitter. In one embodiment, each first end 12 is placed between two electrodes 22.

In step S312, when the pressure driving device is driven, a pressure between the movable spot welding head and the fixed spot welding head is ranged from about 50N to about 20N. In step S313, welding the lower edges of the two electrodes 22 to weld the two electrodes 22 together to fix the first end 12 of the graphitized carbon nanotube wire. The output voltage is ranged from about 2.3V to about 10V, the output current is 800 A, and the output voltage and current release time are controlled at a range about 200 ms to 300 ms.

Furthermore, when the carbon nanotube field emitter comprises a plurality of the emission units, the method of making for the carbon nanotube field emitter may comprises a step of repeatedly stacking a plurality of the emission units after step S311.

When the first end 12 of the at least one graphitized carbon nanotube wire is fixed between the at least two electrodes 22 by laser welding comprises the following substeps: S321, placing the first end 12 of the at least one graphitized carbon nanotube wire between the two electrodes 22, wherein the adjacent two electrodes 22 clamps the at least one graphitized carbon nanotube wire, and the second end 14 is exposed to form an emission unit; S322, clamping and fixing the emitting unit with a clamp; S323, welding the adjacent electrode 22 by laser irradiation to fix the first end 12 of the at least one graphitized carbon nanotube wire.

In step S321, the emission unit may comprise only one graphitized carbon nanotube wire, and may also comprises a plurality of graphitized carbon nanotube wires. When the emitting unit comprises a plurality of graphitized carbon nanotube wires, the plurality of graphitized carbon nanotube wires are spaced apart from each other and sandwiched and fixed by the adjacent two electrodes 22. In one embodiment, the distance between adjacent two graphitized carbon nanotube wires is uniform. When the first end 12 of the graphitized carbon nanotube wire is placed between the two electrodes 22, the lengthwise direction of the graphitized carbon nanotube wire is set to be parallel to the electron emission of the carbon nanotube field emitter direction. In one embodiment, when the graphitized carbon nanotube wire is an untwisted carbon nanotube wire, the extending direction of the carbon nanotubes in the graphitized carbon nanotube wire is parallel to the electron emission direction of the carbon nanotube field emitter. When the graphitized carbon nanotube wire is a twisted carbon nanotube wire, the carbon nanotubes in the graphitized carbon nanotube wire are helically oriented around the electron emission direction of the carbon nanotube field emitter. In one embodiment, each first end 12 is placed between two electrodes 22.

In step S323, the laser may be any type of laser as long as the effect of heating can be produced, such as, a carbon dioxide laser, a semiconductor laser, an ultraviolet laser, or an yttrium aluminum garnet (YAG) laser. A diameter of the laser beam ranges from about 10 micrometers to about 400 micrometers. A power of the laser beam ranges from about 3.6 watts to about 1.5 kilowatts. A laser pulse frequency of the laser beam ranges from about 20 kHz to 40 kHz. In one embodiment, the laser is the YAG laser, a wavelength of the YAG laser is 1.06 μm, a laser beam spot diameter of the YAG laser is 400 μm, a power of the YAG laser is 1.5 KW, and a laser pulse frequency of the YAG laser is 20 kHz.

Furthermore, when the carbon nanotube field emitter comprises a plurality of the emission units, the method of making for the carbon nanotube field emitter may comprises a step of repeatedly stacking a plurality of the emission units after step S321.

The electrode 22 can be a sheet-like structure or a flattened tubular structure. The material of the electrode 22 may be one of gold, silver, copper, and nickel. The electrode 22 has a thickness of 50 micrometers to 150 micrometers. When the electrode 22 is a flattened tubular structure, the first end portion 12 of the at least one graphitized carbon nanotube wire is disposed in the intermediate space of the flattened tubular structure and is crushed tubular. The structure is clamped, and then the first end portion 12 of the at least one graphitized carbon nanotube wire is fixed in the flattened tubular structure by welding the bottom of the collapsed tubular structure.

The electrode 22 can be a sheet structure or a flattened tubular structure. The material of the electrode 22 may be gold, silver, copper, or nickel. A thickness of the electrode 22 ranges from about 50 micrometers to about 150 micrometers. When the electrode 22 is a flattened tubular structure, the first end 12 of the at least one graphitized carbon nanotube wire is disposed in the intermediate space of the flattened tubular structure and is clamped by the flattened tubular structure, and then the first end 12 of the at least one graphitized carbon nanotube wire is fixed in the flattened tubular structure by welding the bottom of the flattened tubular structure. In one embodiment, the electrode 22 consists of a flattened nickel tube. The first end 12 of the at least one graphitized carbon nanotube wire is disposed in the intermediate space of the flattened nickel tube and is clamped by the flattened nickel tube, and then the first end 12 of the at least one graphitized carbon nanotube wire is fixed in the flattened nickel tube by welding the flattened nickel tube. A wall thickness of the nickel tube is 100 microns.

In one embodiment, the carbon nanotube field emitter comprises six emission units. Each emission unit comprises five graphitized carbon nanotube wires and one flattened nickel tube. Five e graphitized carbon nanotube wires are spaced apart from each other and fixed in the flattened nickel tube.

Further, before step S2, the method comprises a step of: cutting the graphitized carbon nanotube wire. In this step, the graphitized carbon nanotube wire is cut to a required length as needed. In on embodiment, the graphitized carbon nanotube wire has a length of 4 mm.

Further, after step S3, the method comprises a step of: cutting the second end 14 of the at least one graphitized carbon nanotube wire with a laser.

The second end 14 is cut with a laser beam from a laser controller controlled by a computer to make the second end 14 has an emitting tip. For example, the second end 14 is cut into a zigzag shape. The laser may be any type of laser as long as the heating effect can be produced, such as, a carbon dioxide laser, a semiconductor laser, an ultraviolet laser, or an yttrium aluminum garnet (YAG) laser. The wavelength, power, scanning speed, and laser beam spot diameter of the laser beam can be set according to actual needs. In one embodiment, the second end 14 has zigzag shape. A distance from the tip end of the second end 14 to the top of the electrode 22 is ranged from about 100 micrometers to about 5 millimeters. In one embodiment, the distance from the tip end of the second end 14 to the top of the electrode 22 is ranged from about from 100 micrometers to about 1 millimeter. In another embodiment, the distance from the tip end of the second end 14 to the top of the electrode 22 is 250 micrometers.

Further, after the second end 14 of the at least one graphitized carbon nanotube wire is cut by laser, the method comprises a step of: ultrasonically cleaning the carbon nanotube field emitter 100. Ultrasonically cleaning the carbon nanotube field emitter 100 can remove loose carbon nanotubes and impurities in the second end 14 which is beneficial to improve the field emission performance and lifetime of the carbon nanotube field emitter.

In one embodiment, the carbon nanotube field emitter 100 cut by laser is placed in an organic solvent for ultrasonic cleaning for about 15 minutes to about 1 hour, and then the carbon nanotube field emitter 100 is dried. The ultrasonic cleaning frequency is ranged from about 3 kHz to 10 kHz, and the organic solvent is deionized water.

Further, the method comprises a step of: depositing a carbon layer on a surface of the at least one graphitized carbon nanotube wire after step S2. The carbon layer is uniformly coated on the surface of the at least one graphitized carbon nanotube wire to form a carbon nanotube wire composite structure. The carbon layer can further increase the mechanical properties of the graphitized carbon nanotube wire, thereby increasing the emission stability of the carbon nanotube field emitter.

Referring to FIG. 4-7, the carbon nanotube field emitter 100 prepared by the method for making the carbon nanotube field emitter is provided. The carbon nanotube field emitter 100 comprises at least one emission unit. Each emission unit comprises at least two electrodes 22 and at least one graphitized carbon nanowire. Each graphitized carbon nanowire comprises a first end 12 and a second end 14, and the second end 14 is opposite the first end 12. The first end 12 of the at least one graphitized carbon nanowire is fixed and sandwiched between adjacent two electrodes 22, and the second end 14 of the at least one graphitized carbon nanowire is exposed from the at least two electrodes 22 as an electron emission end.

When the carbon nanotube field emitter 100 comprises a plurality of the emission units, the plurality of the emission units are stacked and fixed together by welding. When one emission unit comprises a plurality of graphitized carbon nanotube wires, the plurality of graphitized carbon nanotube wires are spaced apart from each other and fixed between the adjacent two electrodes 22. In one embodiment, the distance between adjacent two graphitized carbon nanotube wires is same.

The at least one graphitized carbon nanotube wire may be an untwisted carbon nanotube wire or a twisted carbon nanotube wire. When the graphitized carbon nanotube wire is the untwisted carbon nanotube wire, the extending direction of the carbon nanotubes in the graphitized carbon nanotube wire is parallel to the electron emission direction of the carbon nanotube field emitter. When the graphitized carbon nanotube wire is the twisted carbon nanotube wire, the carbon nanotubes in the graphitized carbon nanotube wire are helically oriented around the electron emission direction of the carbon nanotube field emitter.

Further, the second end of the graphitized carbon nanotube wire comprises an emission tip. The distance from the emitting tip of the second end 14 to the top of the electrode 22 is ranged from about 100 micrometers to about 5 millimeters. In one embodiment, the distance from the emitting tip of the second end 14 to the top of the electrode 22 is ranged from about 100 micrometers to about 1 millimeter. In another embodiment, the distance from the emitting tip of the second end 14 to the top of the electrode 22 is 250 microns.

The electrode 22 can be a sheet structure or a flattened tubular structure. The material of the electrode 22 may be gold, silver, copper, or nickel. A thickness of the electrode 22 ranges from about 50 micrometers to about 150 micrometers. When the electrode 22 is a flattened tubular structure, the first end 12 of the at least one graphitized carbon nanotube wire is disposed in the intermediate space of the flattened tubular structure and is clamped by the flattened tubular structure, and then the first end 12 of the at least one graphitized carbon nanotube wire is fixed in the flattened tubular structure by welding the bottom of the flattened tubular structure. In one embodiment, the electrode 22 consists of a flattened nickel tube. The first end 12 of the at least one graphitized carbon nanotube wire is disposed in the intermediate space of the flattened nickel tube and is clamped by the flattened nickel tube, and then the first end 12 of the at least one graphitized carbon nanotube wire is fixed in the flattened nickel tube by welding the bottom of the flattened nickel tube. A wall thickness of the nickel tube is 100 microns.

In one embodiment, the carbon nanotube field emitter comprises six emission units. Each emission unit comprises five graphitized carbon nanotube wires and one flattened nickel tube. Five e graphitized carbon nanotube wires are spaced apart from each other and fixed in the flattened nickel tube.

In one embodiment, the carbon nanotube field emitter comprises a carbon layer. The carbon layer is uniformly coated on a outside surface of the at least one graphitized carbon nanotube wire to form a carbon nanotube wire composite structure. In one embodiment, the carbon layer is uniformly coated on a whole outside surface of the at least one graphitized carbon nanotube wire to form a carbon nanotube wire composite structure. The carbon layer can further increase the mechanical properties of the graphitized carbon nanotube wire, thereby increasing the emission stability of the carbon nanotube field emitter.

The carbon nanotube field emitter provided by the invention has the following advantages: Firstly, the heating treatment of carbon nanotube wire can remove the catalyst and repair the defects of the carbon nanotubes. Therefore, the stability and service life of the carbon nanotube field emitter can be improved. Secondly, the graphitized carbon nanotube wire can be firmly fixed between the adjacent two electrodes by the welding the electrode, and the bonding force between the carbon nanotube wire and the electrode can be improved. Thus, the graphitized carbon nanotube wire does not detach from the electrode during electron emission, and the emission efficiency and service life of the carbon nanotube field emitter can be improved.

Even though numerous characteristics and advantages of certain inventive embodiments have been set out in the foregoing description, together with details of the structures and functions of the embodiments, the disclosure is illustrative only. Changes may be made in detail, especially in matters of arrangement of parts, within the principles of the present disclosure to the full extent indicated by the broad general meaning of the terms in which the appended claims are expressed.

Depending on the embodiment, certain of the steps of methods described may be removed, others may be added, and the sequence of steps may be altered. It is also to be understood that the description and the claims drawn to a method may comprise some indication in reference to certain steps. However, the indication used is only to be viewed for identification purposes and not as a suggestion as to an order for the steps.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A method for making a carbon nanotube field emitter, comprising:

S1, providing at least one carbon nanotube wire and at least two electrodes;

S2, heating the at least one carbon nanotube wire to form at least one graphitized carbon nanotube wire, wherein the at least one graphitized carbon nanotube wire comprises a first end and a second end, and the first end is opposite to the second end; and S3, welding the at least two electrodes to fix the first end between the at least two electrodes, wherein the second end of the at least one graphitized carbon nanotube wire is exposed from the at least two electrodes, the second end is an electron emission end.

2. The method of claim 1, wherein the first end of the at least one graphitized carbon nanotube wire is fixed between the at least two electrodes by spot welding or laser welding.

3. The method of claim 1, wherein the first end of the at least one graphitized carbon nanotube wire is fixed between the at least two electrodes by a spot welding method, the spot welding method comprising steps of:

S311, placing the first end of the at least one graphitized carbon nanotube wire between the at least two electrodes, wherein each of the least two electrode clamps the at least one graphitized carbon nanotube wire, and the second end is exposed to form an emission unit;

S312, placing the emission unit between a fixed welding head and a movable spot welding head, and driving a pressure driving device to press the movable spot welding head against the fixed spot welding head; and S313, controlling a spot welder output a voltage and a current to weld the at least two electrodes together to fix the first end of the at least one graphitized carbon nanotube wire.

4. The method for making a carbon nanotube field emitter of claim 1, wherein the first end of the at least one graphitized carbon nanotube wire is fixed between the at least two electrodes by a laser welding method, the laser welding method comprising steps of:

S321, placing the first end of the at least one graphitized carbon nanotube wire between the at least two electrodes wherein the each of the at least tow electrodes clamps the at least one graphitized carbon nanotube wire, and the second end is exposed to form an emission unit;

S322, clamping and fixing the emitting unit with a clamp; and

S323, welding the at least two electrodes by laser irradiation to fix the first end of the at least one graphitized carbon nanotube wire.

5. The method for making a carbon nanotube field emitter of claim 1, further comprising a step of cutting the second end of the at least one graphitized carbon nanotube wire with a laser after S3.

6. The method for making a carbon nanotube field emitter of claim 5, further comprising a step of ultrasonically cleaning the second end of the at least one graphitized carbon nanotube wire.

7. The method for making a carbon nanotube field emitter of claim 1, further comprising a step of depositing a carbon layer on a surface of the at least one graphitized carbon nanotube wire after S2.

8. A carbon nanotube field emitter, comprising:

at least one emission, comprising at least two electrodes and at least one graphitized carbon nanowire, wherein the at least one graphitized carbon nanowire comprises a first end and a second end opposite to the first end, the first end of the at least one graphitized carbon nanowire is fixed between the at least two electrodes, and the second end of the at least one graphitized carbon nanowire is exposed from the at least two electrodes, the second end is an electron emission end.

9. The carbon nanotube field emitter of claim 8, wherein the carbon nanotube field emitter comprises a plurality of the emission units, and the plurality of the emission units are stacked and welded together.

10. The carbon nanotube field emitter of claim 8, wherein the at least one graphitized carbon nanotube wire is an untwisted carbon nanotube wire or a twisted carbon nanotube wire.

11. The carbon nanotube field emitter of claim 8, wherein each of the at least one emission unit comprises a plurality of graphitized carbon nanotube wires, and the plurality of graphitized carbon nanotube wires are spaced apart from each other and fixed between the at least two electrodes.

12. The carbon nanotube field emitter of claim 8, wherein the carbon nanotube field emitter comprises a carbon layer, and the carbon layer is uniformly coated on a outside surface of the at least one graphitized carbon nanotube wire.

* * * * *